United States Patent [19]

Sickler

[11] Patent Number: 4,572,114

[45] Date of Patent: Feb. 25, 1986

[54] PROCESS AND APPARATUS FOR COMPRESSION RELEASE ENGINE RETARDING PRODUCING TWO COMPRESSION RELEASE EVENTS PER CYLINDER PER ENGINE CYCLE

[75] Inventor: Kenneth H. Sickler, Simsbury, Conn.

[73] Assignee: The Jacobs Manufacturing Company, Bloomfield, Conn.

[21] Appl. No.: 728,947

[22] Filed: Apr. 30, 1985

Related U.S. Application Data

[63] Continuation-in-part of Ser. No. 616,125, Jun. 1, 1984, abandoned.

[51] Int. Cl.[4] ..... F02B 69/06

[52] U.S. Cl. ..... 123/21; 123/90.13; 123/90 15; 123/321

[58] Field of Search ..... 123/321, 322, 21, 90.15, 123/90.16, 198 F, 90.12, 90.13, DIG. 7

[56] References Cited

U.S. PATENT DOCUMENTS

| | | | |
|---|---|---|---|
| 2,178,152 | 10/1939 | Walker | 123/321 |
| 2,785,668 | 3/1957 | Dehmer | 123/21 |
| 3,220,392 | 11/1965 | Cummins | 123/321 |
| 3,367,312 | 2/1968 | Jonsson | 123/321 |
| 3,405,699 | 10/1968 | Laas | 123/320 |
| 3,439,662 | 4/1969 | Jones et al. | 123/321 |
| 3,547,087 | 12/1970 | Siegler | 123/90.16 |
| 3,786,792 | 1/1974 | Pelizzoni et al. | 123/321 |
| 3,859,970 | 1/1975 | Dreisin | 123/320 |
| 4,000,756 | 1/1977 | Ule et al. | 137/596.17 |
| 4,009,695 | 3/1977 | Ule | 123/90.13 |
| 4,150,640 | 4/1979 | Egan | 123/321 |
| 4,174,687 | 11/1979 | Fuhrmann | 123/90.13 |
| 4,271,796 | 6/1981 | Sickler et al. | 123/321 |
| 4,296,605 | 10/1981 | Price | 60/599 |
| 4,392,459 | 7/1983 | Chareire | 123/21 |
| 4,398,510 | 8/1983 | Custer | 123/321 |
| 4,399,787 | 8/1983 | Cavanagh | 123/321 |
| 4,423,712 | 1/1984 | Mayne et al. | 123/321 |
| 4,485,780 | 12/1984 | Price et al. | 123/321 |
| 4,510,900 | 4/1985 | Quenneville | 123/321 |

FOREIGN PATENT DOCUMENTS

| | | | |
|---|---|---|---|
| 3129609 | 3/1983 | Fed. Rep. of Germany | 123/DIG. 7 |

*Primary Examiner*—William A. Cuchlinski, Jr.
*Attorney, Agent, or Firm*—Donald E. Degling

[57] ABSTRACT

Process and apparatus for the compression release retarding of a multi-cylinder four cycle internal combustion engine are provided. The process provides a compression release event for each cylinder during each revolution of the engine crankshaft. In accordance with the process, the normal motion of the exhaust and intake valves is inhibited and the exhaust valves are opened briefly at each time the engine piston approaches the top dead center position. The intake valves are opened after each opening of the exhaust valves. The apparatus includes hydraulic means driven by the engine push-tubes which produce a timed hydraulic pulse adapted to open the exhaust and intake valves at the proper time. Hydraulically actuated means are provided to disable the valve crosshead or rocker arm so as to inhibit the normal motion of the valves. Alternatively, timed signals from an electronic controller actuate solenoid valves to control a hydraulic pulse which opens the valves. Solenoid means may also be provided to open the valves mechanically.

9 Claims, 8 Drawing Figures

PROCESS AND APPARATUS FOR COMPRESSION RELEASE ENGINE RETARDING PRODUCING TWO COMPRESSION RELEASE EVENTS PER CYLINDER PER ENGINE CYCLE

This application is a continuation-in-part of application Ser. No. 616,125, filed June 1, 1984 now abandoned.

BACKGROUND OF THE INVENTION

1. Field of the Invention

This invention relates generally to the field of compression release retarders for internal combustion engines. More particularly, it relates to a compression release engine retarder employing an hydraulic valve actuating mechanism wherein during the retarding mode of operation, the engine is converted from the normal four-stroke cycle to a two-stroke cycle thereby doubling the number of compression release events per unit of time.

2. Prior Art

Engine retarders of the compression release type are well-known in the art. Such engine retarders are designed to convert, temporarily, an internal combustion engine of the spark ignition or compression ignition type into an air compressor so as to develop a retarding horsepower which may be a substantial portion of the operating horsepower developed by the engine.

The compression release engine retarder of the type disclosed in Cummins U.S. Pat. No. 3,220,392 employs an hydraulic system wherein the motion of a master piston controls the motion of a slave piston which, in turn, opens the exhaust valve of the internal combustion engine near the end of the compression stroke whereby the work done in compressing the intake air is not recovered during the expansion or "power" stroke, but, instead, is dissipated through the exhaust and radiator system of the vehicle. The master piston is customarily driven by a pushtube controlled by a cam on the engine camshaft which may be associated with the fuel injector of the cylinder involved or with the intake or exhaust valve of another cylinder.

Other mechanisms may also be used to produce the compression release effect. In Jonsson U.S. Pat. No. 3,367,312, the exhaust valves are sequentially opened near the end of the compression stroke by a separate cam profile formed on the exhaust valve cam and actuated by oscillating the axis of the rocker arm shaft or providing a lost motion mechanism in the rocker arm. See also Cartledge U.S. Pat. No. 3,809,033 which discloses a compression release retarder employing a dual-action cam and a rocker arm having an hydraulically extensible lash take-up piston.

In Pelizzoni U.S. Pat. No. 3,786,792 a system for varying the valve timing for a multi-cylinder engine is disclosed in order to improve, inter alia, the compression release retarding effect. The mechanism disclosed includes hydraulic means to lengthen the valve train so as to utilize a secondary cam profile. The valve train may be lengthened, for example, by increasing the length of the pushtube or providing an extension from the rocker arm.

In Dreisin U.S. Pat. No. 3,859,970 an additional cam is provided on the camshaft to operate a pump which, in turn, operates an hydraulic lifter to move the desired exhaust or intake valve pushtube.

Another approach to compression release retarding involves holding either the exhaust or intake valves, or both, partially open during the retarding operation. A mechanism designed to accomplish this result is disclosed in the Siegler U.S. Pat. No. 3,547,087.

Despite the various mechanisms disclosed in the prior art, this art all relates to the standard four-stroke cycle engine which provides one compression stroke per cylinder and therefore one compression release event per cylinder for every two revolutions of the crankshaft.

Since the issuance of the basic compression release patents, including the Cummins U.S. Pat. No. 3,220,392, development efforts have been directed toward improving the retarding horsepower by improving the timing of the compression release event (Custer U.S. Pat. No. 4,398,510), preventing overtravel of the slave piston (Laas U.S. Pat. No. 3,405,699), preventing overpressure of the hydraulic system (Egan U.S. Pat. No. 4,150,640), preventing overload of the injector pushtube or camshaft (Sickler U.S. Pat. No. 4,271,796) and increasing the inlet manifold pressure during retarding (Price U.S. Pat. No. 4,296,605). However, in each instance the engine continues to operate in the standard four-stroke cycle mode so as to produce one compression release event per cylinder for every two crankshaft revolutions.

SUMMARY OF THE INVENTION

In the present state of the art, the retarding horsepower developed by a standard four-cycle internal combustion engine is limited by the fact that each cylinder is able to produce a compression release event only once during every two revolutions of the crankshaft. Recognizing that the exhaust stroke of the cylinder represents a motion analogous to the compression stroke during which air could also be compressed, with an appropriate action of the intake and exhaust valves, applicant has provided an automatic mechanism to accomplish this result. In effect, applicant has converted an engine having a four-stroke cycle during the powering mode of operation into a compressor having a two-stroke cycle during the retarding mode of operation thereby doubling the number of compression release events in any given period of time. By doubling the number of compression release events per unit of time, the total retarding horsepower may approach twice the retarding horsepower of an engine equipped with a standard engine retarder without increasing the loading of the engine components. Applicant's mechanism includes means to disable, temporarily, the action of the exhaust and intake valves and means to operate both the intake and the exhaust valves in other than the normal sequence of operations. The means to operate the intake valves out of normal sequence includes master and slave pistons hydraulically interconnected with the existing master and slave pistons of the standard retarder, together with appropriate conduits and check or shuttle valves. In addition, the existing master pistons, or an extra set of master pistons, for each cylinder are hydraulically interconnected with the intake master and slave pistons.

In an alternative arrangement, timing is accomplished by sensors and an electronic controller; and solenoid valves and actuators are employed in place of certain of the hydraulic mechanisms.

DETAILED DESCRIPTION OF THE INVENTION

Figure 1:
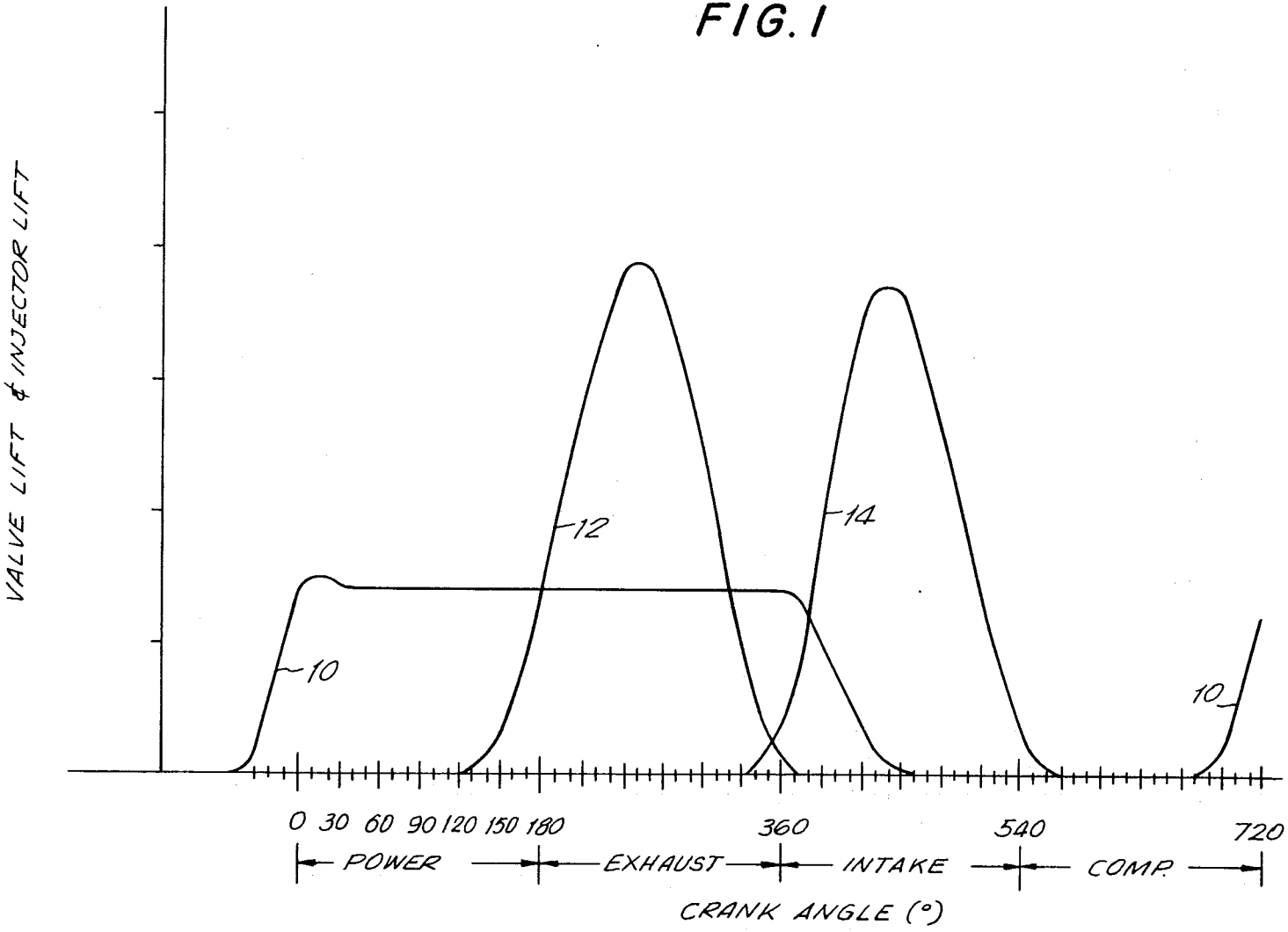
FIG. 1 is a graph showing valve and fuel injector lift as the ordinate and crank angle as the abscissa for a standard compression ignition engine employing fuel injectors.

Referring first to FIG. 1, the curves presented relate to a standard four-cycle internal combustion engine of the compression ignition type having fuel injectors, intake valves and exhaust valves operated by pushtubes acting through rocker arms and actuated by cams driven from the engine camshaft. The camshaft is synchronized with the engine crankshaft but operates at half the speed of the crankshaft. FIG. 1 is a plot of valve lift and fuel injector lift against crankshaft angle over two revolutions (720°) of the crankshaft.

Curve 10 shows the action of the fuel injector for Cylinder No. 1 with its motion beginning towards the end of the compression stroke (540°–720°). The fuel injector is fully seated shortly after the top dead center (T.D.C.) position of the piston (0°) at the beginning of the expansion of power stroke of the engine (0°–180°). As shown in FIG. 1, the fuel injector remains fully seated during the power and exhaust strokes (0°–360°) and moves back to its rest position during the intake stroke (360°–540°). The beginning of the second cycle of operation of the fuel injector is shown at the extreme right end of FIG. 1.

Curve 12 relates to the exhaust valve for Cylinder No. 1. Typically, the exhaust valve begins to open toward the end of the power stroke (0°–180°), remains open during the exhaust stroke (180°–360°) and closes during the intake stroke (360°–540°).

Curve 14 represents the motion of the intake valve for Cylinder No. 1. Typically, the intake valve begins to open toward the end of the exhaust stroke (180°–360°), remains open during the intake stroke (360°–540°) and closes during the compression stroke (540°–720°). It will be seen that there is normally a period of overlap during which both the exhaust and inlet valves are partially open. As shown in FIG. 1, the valve overlap is somewhat in excess of 20 crank angle degrees.

Figure 2:
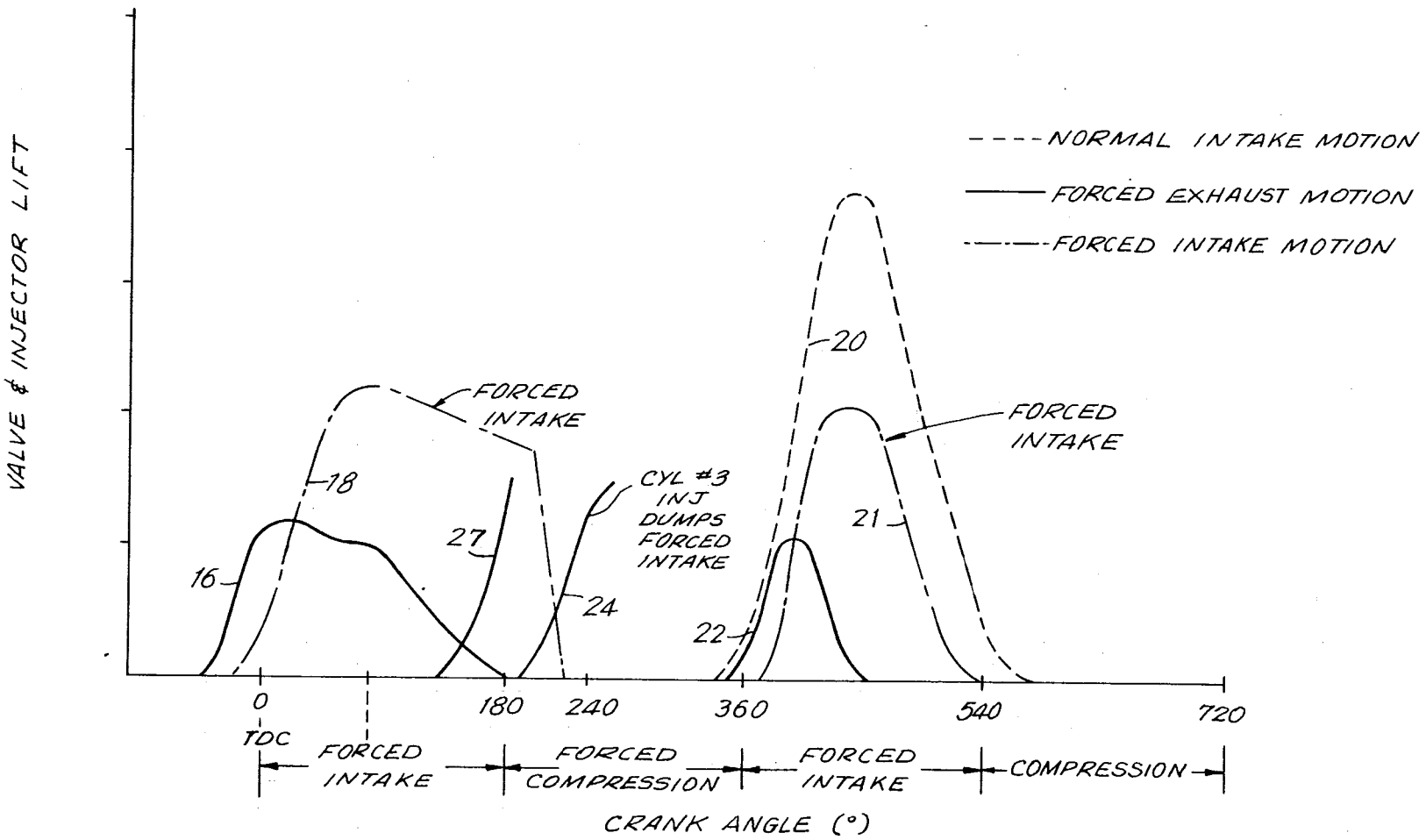
FIG. 2 is a graph similar to FIG. 1 showing the modified valve action in accordance with the present invention wherein the compression release engine retarder is driven from the fuel injector pushtubes and the second compression release event occurs about 360° of crankshaft rotation after the first compression release event.

With the above understanding of the normal valve action represented by FIG. 1, reference may be made to FIG. 2 which shows a modified valve action in accordance with the present invention so as to produce two compression release events per cylinder during each two revolutions of the engine crankshaft (720°). Like FIG. 1, FIG. 2 is a graph of valve lift and fuel injector lift against crankshaft angle over two revolutions (720°) of the crankshaft.

Curve 16 of FIG. 2 represents the motion of the exhaust valve for Cylinder No. 1, the initial rise of which is caused by the fuel injector motion shown by Curve 10 of FIG. 1. During the retarding mode of operation, the fuel supply is shut off or reduced so that little or no fuel is injected into the engine cylinder. For simplicity and clarity the present invention will be explained with reference to only one cylinder of a six cylinder compression ignition engine having a modified Jacobs engine retarder driven by the fuel injector pushtubes. The standard Jacobs engine retarder is described, for example, in Sickler et al. U.S. Pat. No. 4,271,796, hereby incorporated by reference in its entirety.

In FIG. 2, there is no counterpart for Curve 12 of FIG. 1 since, as will be described below, applicant provides a mechanism to disable, temporarily, the exhaust valve motion. Simultaneously, applicant opens the intake valve during the normal "power" stroke in accordance with Curve 18 in what may be termed a "forced intake" action by means of a mechanism also to be described below. Curve 24 on FIG. 2 represents the motion of the fuel injector pushtube for Cylinder No. 3 which is used, as described below, to insure closure of the intake valve, the motion of which is shown by Curve 18. Curve 20 is shown in FIG. 2 in dotted lines to show where the normal intake valve action (Curve 14 of FIG. 1) would occur. This motion is also inhibited by applicant's mechanism which, in essence, advances the motion of the intake valve by about 360 crank angle degrees. In place of the normal intake valve opening action (Curve 20) applicant's mechanism forces the exhaust valve to open (Curve 22) close to the top dead center position (360°) of the piston thus providing a second compression release event at this point. It will be understood that the motion of the fuel injector (Curve 10 of FIG. 1) opens the exhaust valve close to top dead center (0°), thereby providing the first compression release event as shown by Curve 16. Since the forced exhaust valve openings occur at approximately 0° crank angle and 360° crank angle, there are two compression release events per cylinder for every two revolutions of the crankshaft.

Curve 21 represents a second opening action of the intake valves which, like the first shown in Curve 18, is a "forced intake" motion. As will be explained in more detail below, the second "forced intake" motion is produced by the intake pushtube for Cylinder No. 1 acting through an intake master piston.

Figure 3:
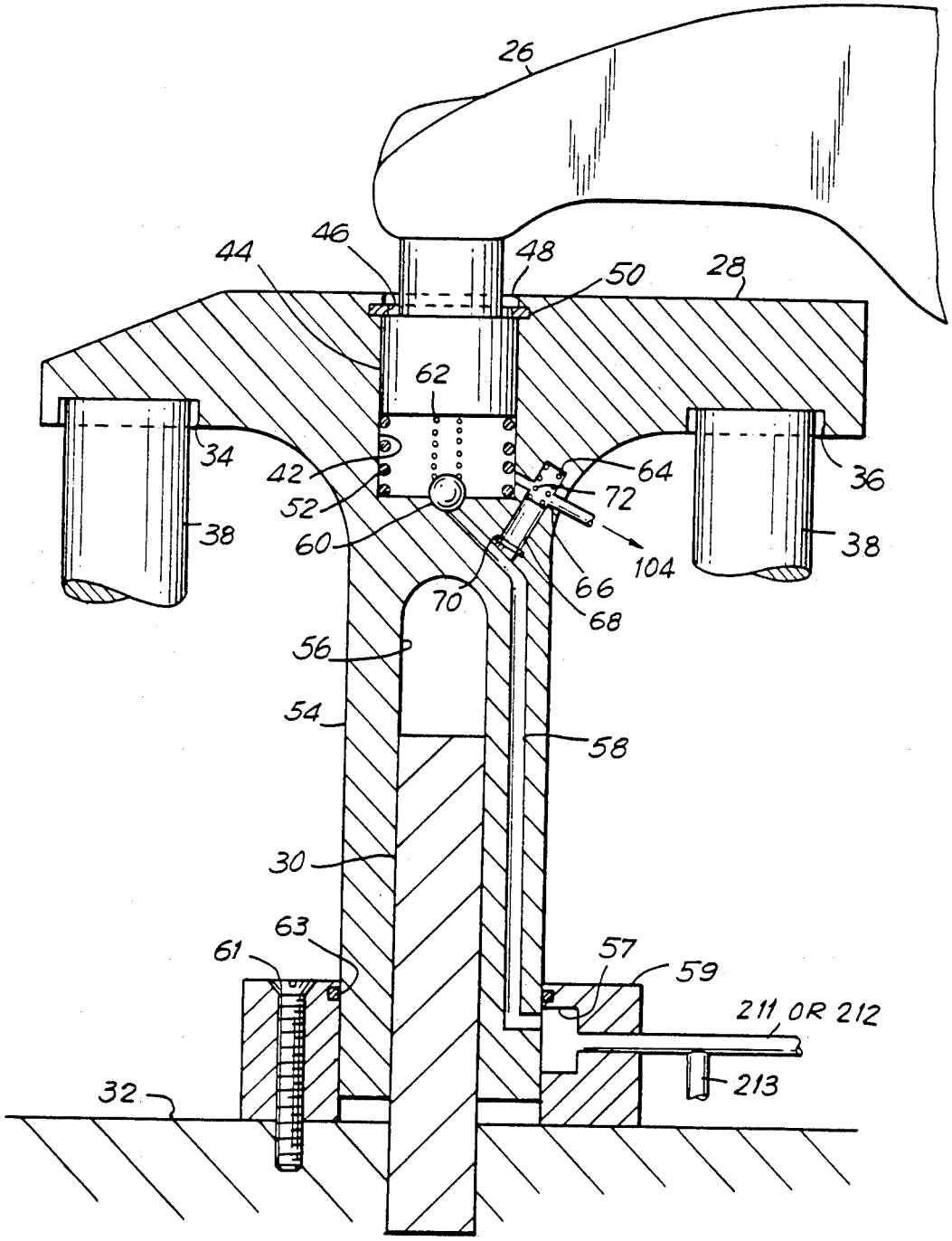
FIG. 3 is an elevational view of an exhaust or intake valve crosshead and rocker arm, partly in section, in accordance with the present invention.

As noted above, in accordance with applicant's invention, it is necessary to disable, temporarily, both the exhaust valves and the intake valves from operating in their normal manner. FIG. 3 illustrates one means for accomplishing this end through a modification of the valve crosshead. Although described below in connection with the exhaust valve crosshead, the same design may be used for the intake valve crosshead.

Referring now to FIG. 3, the exhaust valve rocker arm is indicated at 26. The exhaust valve crosshead 28 is mounted for reciprocating motion on a guide pin 30 affixed to the engine cylinder head 32. The crosshead 28 has formed therein recesses 34 and 36 which receive the stems 38 of the dual exhaust valves. Centrally disposed in the upper surface of the crosshead 28 is a cylindrical cavity 42 within which a closely fitting piston 44 is mounted for reciprocating motion. The piston 44 is provided with a shoulder 46 which is engagable by a snap ring 48 which seats in a groove 50 formed in the wall of the cavity 42 near its open end. A compression spring 52 is located between the bottom of the piston 44 and the bottom of the cavity 42 so as to bias the piston 44 upwardly (as shown in FIG. 3) to a position where the shoulder 46 of the piston abuts against the snap ring 48.

The shank portion 54 of the crosshead contains a generally cylindrical cavity 56 so as to enable the crosshead 28 to reciprocate with respect to the guide pin 30. A passageway 58 communicates between the inlet passage 57 formed in block 59 and the cavity 42 at the top of the crosshead. A ball check valve 60 is positioned within the cavity 42 at the upper end of the passageway 58 and biased downwardly by a compression spring 62 positioned between the ball check valve 60 and the bottom of piston 44. The block 59 may be affixed to the cylinder head 32 by screws 61. Leakage between the block 59 and the shank 54 may be prevented by the O-ring 63 seated in the block 59.

A blind bore 64 is formed in the crosshead 28 with its opening communicating with the passageway 58 positioned in the crosshead shank 54, while a cross bore 66 interconnects the cavity 42, the blind bore 64 and the outside of the crosshead 28. A shuttle valve 68 is mounted for reciprocating motion within the blind bore 64 and is held within the bore 64 by a snap ring 70 and is normally biased toward the snap ring 70 by a compression spring 72. In its deactuated position, as shown in FIG. 3, the shuttle valve 68 does not inhibit or close off the cross bore 66. However, whenever hydraulic pressure exists in the passage 58, hydraulic fluid moves the shuttle valve 68 against the bias of the compression spring 72 so as to close off the cross bore 66. Simultaneously, the check valve 60 is moved against the bias of the spring 62 to permit the flow of hydraulic fluid into the cavity 42.

The hydraulic fluid, such as lubricating oil, may be supplied to the crosshead from the low pressure supply via duct 213 and passageway 58 as will be explained in more detail below with respect to FIGS. 5 and 7.

In operation, when hydraulic fluid is fed into the duct 213 which communicates with ducts 211 or 212 (See FIGS. 5 and 7) and 58, it will also flow past the check valve 60 into cavity 42 and move the shuttle valve 68 so as to block crossbore 66. A downward motion of the rocker arm 26 will actuate the crosshead 28 since the piston 44 is hydraulically locked in its uppermost position against the snap ring 48. However, when the supply of pressurized hydraulic fluid is cut off, the shuttle valve 68 opens the crossbore 66 so that hydraulic fluid may be pumped out of the cavity 42 and through the crossbore 66 which drains to the engine sump 104 as described below. It will be appreciated that under these conditions oscillation of the rocker arm 26 will cause the piston 44 to reciprocate within the cavity 42 against the bias of the spring 52 but no motion will be transferred to the crosshead 28, thereby disabling the crosshead 28 and the exhaust or intake valves.

Figure 4A:
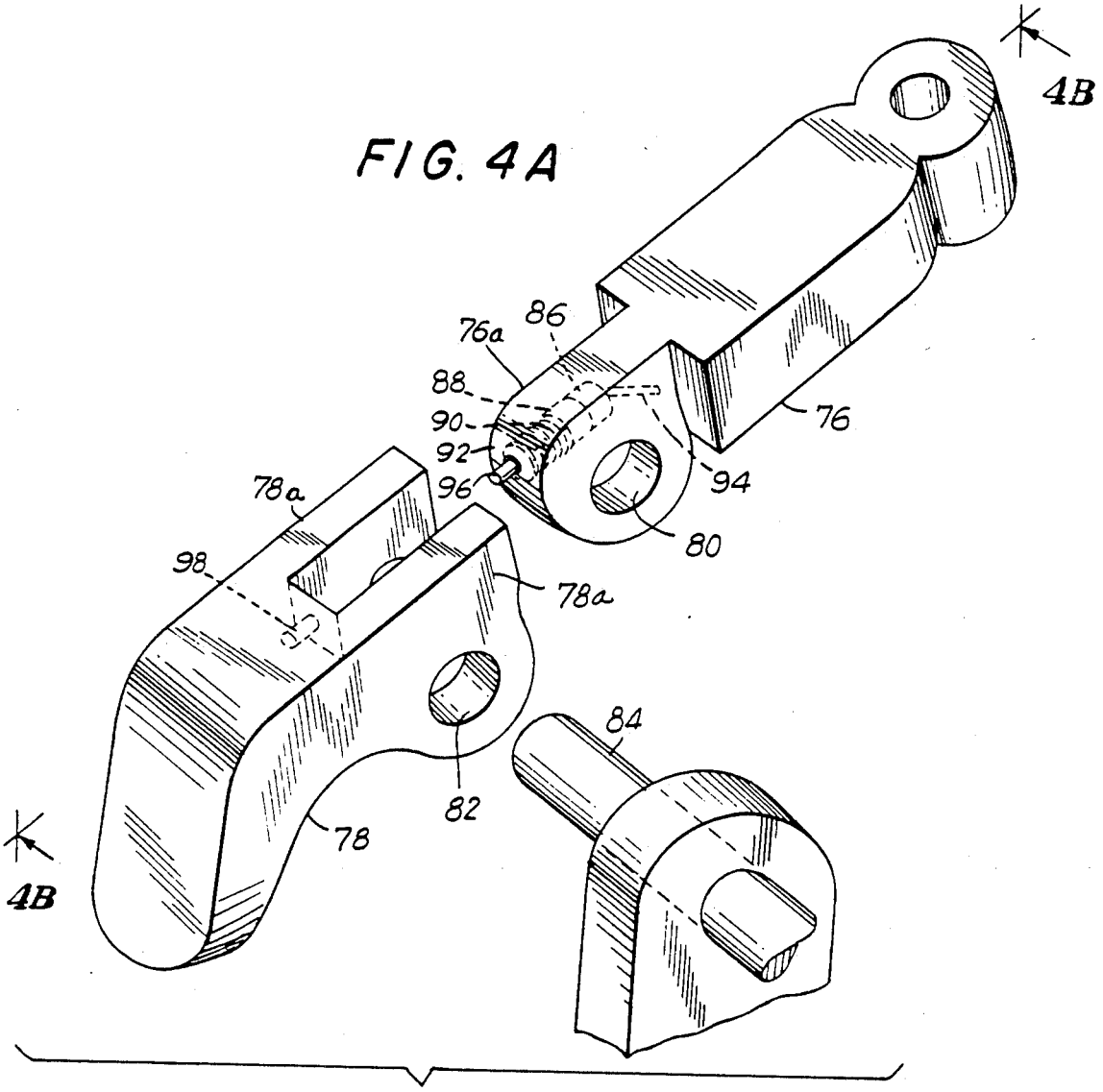
FIG. 4A is an isometric exploded view of a split exhaust or intake valve rocker arm in accordance with the present invention.
Figure 4B:
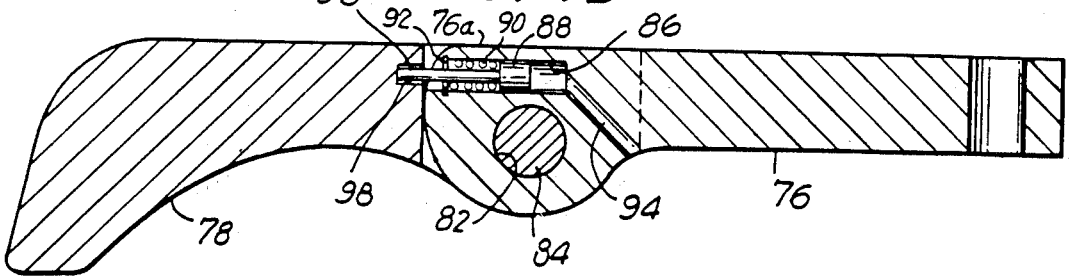
FIG. 4B is a sectional view of the split exhaust or intake valve rocker arm shown in FIG. 4A.

Another means for disabling the exhaust valves or the intake valves is shown in FIGS. 4A and 4B. This alternative means will be described with reference to the exhaust valve rocker arm but is equally applicable to the intake valve rocker arm. FIG. 4B is an elevational view, partly in section, of a modified rocker arm assembly comprising a push-tube section 76 and valve actuating section 78. FIG. 4A is an exploded isometric view of the modified rocker arm assembly of FIG. 4B. Each section is provided with a bushing bore 80, 82 so that the respective sections may oscillate on the rocker arm shaft 84. One section of the rocker arm, for example, the valve actuating section 78, may be bifurcated to form arms 78*a*, while the pushtube section 76 has a complementary arm 76*a*. A cylindrical chamber 86 is formed within the arm 76*a* which receives a piston 88. The piston 88 is biased toward the closed end of the chamber 86 by a compression spring 90 which is seated against a snap ring 92 affixed to the cylindrical chamber 86. A passageway 94 communicates between the inner end of the chamber 86 and a source of pressurized hydraulic fluid. A pin 96 is mounted coaxially with the piston 88 and directed toward the open end of the chamber 86. A bore 98 is formed in the valve actuating section 78 so as to mate with the pin 96 when the piston 88 is driven toward the open end of the chamber 86 by the application of pressurized hydraulic fluid through passageway 94. It will be understood that when the pin 96 mates with the bore 98 the two sections 76 and 78 comprising the rocker arm oscillate as a unit on the rocker arm shaft 84. However, when the pin 96 and bore 98 are not in mating position the pushtube section 76 of the rocker arm oscillates without driving the valve actuating section 78 of the rocker arm.

A further alternative way to disable the exhaust or intake valves is to provide an eccentric bushing in the rocker arm pivot point so as to raise the pivot or fulcrum and thereby introduce a lost motion into the valve train. Such a device is shown, for example, in the Jonsson U.S. Pat. No. 3,367,312, hereby incorporated by reference in its entirety. As noted above, other lost motion mechanisms are also available. See, for example, Pelizzoni U.S. Pat. No. 3,786,792, hereby incorporated by reference in its entirety.

Figure 5:
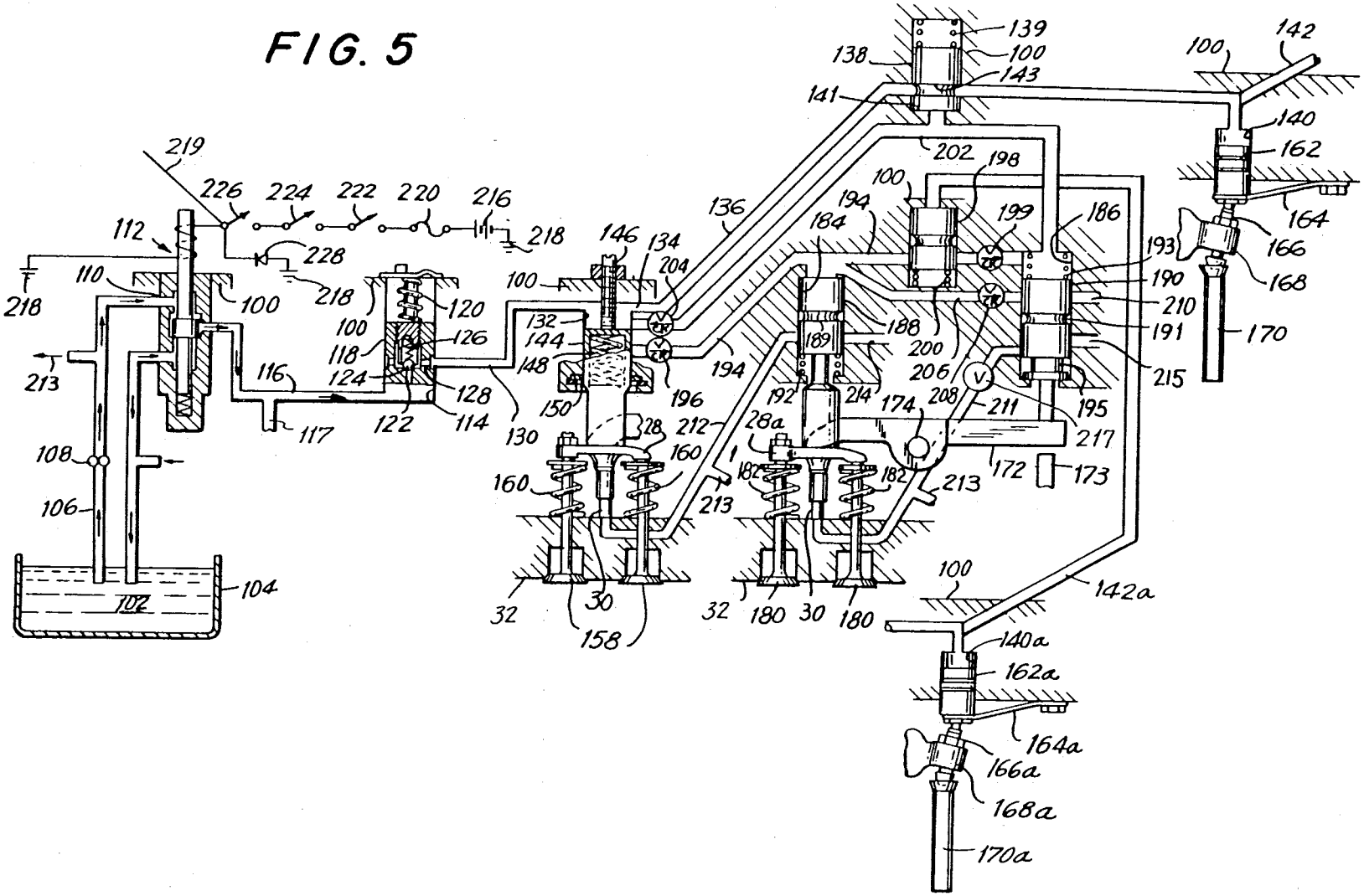
FIG. 5 is a diagrammatic view of the mechanism of the present invention showing the arrangement of the components required for each engine cylinder.

Reference is now made to FIG. 5 which illustrates, in schematic form, apparatus arranged to practice applicant's invention. This apparatus includes the parts which function as a standard four-stroke cycle engine retarder plus the additional elements which double the number of compression release events per unit of time. The numeral 100 represents a housing fitted on an internal combustion engine within which the components of the compression release engine retarder are contained. Oil 102 from a sump 104 which may be, for example, the engine crankcase, is pumped through a duct 106 by a low pressure pump 108 to the inlet 110 of a solenoid valve 112 mounted in the housing 100. Low pressure oil 102 is conducted from the solenoid valve 112 to a control cylinder 114 through a duct 116. A control valve 118 is fitted for reciprocating movement within the control cylinder 114 and is biased toward a closed position by a compression spring 120. The control valve 118 contains an inlet passage 122 closed by a ball check valve 124 which is biased toward the closed position by a compression spring 126, and an outlet passage 128. When the control valve 118 is in the open position (as shown in FIG. 5) the outlet passage 128 registers with the control cylinder outlet duct 130 which communicates with the inlet of a slave bore 132 also formed in the housing 100. It will be understood that low pressure oil 102 passing through the solenoid valve 112 enters the control valve cylinder 114 and raises the control valve 118 to the open position. Thereafter, the ball check valve 124 opens against the bias of spring 126 to permit the oil 102 to flow into the slave bore 132. From a first outlet 134 of the slave bore 132 the oil 102 flows through a duct 136 and a shuttle valve 138 into a master bore 140 formed in the housing 100. A spring 139 biases shuttle valve 138 against a shoulder 141 in duct 136 so as to align the annulus 143 of the shuttle valve 138 with the duct 136. The shuttle valve 138 can be actuated by hydraulic pressure in duct 202 due to an upward movement of intake master piston 190 as described below. A duct 142 communicates with duct 136 and master bore 140 and leads to the shuttle valve (similar to shuttle valve 198 described below) located between the intake master and slave pistons of Cylinder No. 2 (not shown) as will be explained in more detail below.

A slave piston 144 is fitted for reciprocating motion within the slave bore 132. The slave piston 144 is biased in an upward direction (as shown in FIG. 5) against an adjustable stop 146 by a compression spring 148 which is mounted within the slave piston 144 and acts against a bracket 150 seated in the slave bore 132. The lower end of the slave piston 144 acts against a crosshead 28 fitted for reciprocating motion on a guide pin 30 fastened to the cylinder head 32 of the internal combustion engine. The crosshead 28, in turn, acts against the stems of exhaust valves 158 which are movably seated in the cylinder head 32. The exhaust valves 158 are normally biased toward a closed position (as shown in FIG. 5) by valve springs 160. Normally, the adjustable stop 146 is set to provide a minimum clearance (i.e. "lash") of, for example, at least 0.018 inch between the slave piston 144 and the crosshead 28 when the exhaust valves 158 are closed, the slave piston 144 is seated against the adjustable stop 146 and the engine is cold. This clearance is designed to be sufficient to accommodate expansion of the parts comprising the exhaust valve train when the engine is hot without opening the exhaust valves 158.

A master piston 162 is fitted for reciprocating movement within the master bore 140 and biased in an upward direction (as shown in FIG. 5) by a light leaf spring 164. The lower end of the master piston 162 contacts an adjusting screw mechanism 166 for the fuel injector rocker arm 168 actuated by a pushtube 170 driven from the engine camshaft (not shown). Referring to FIG. 5, if the valves 158 are associated with Cylinder No. 1, then the pushtube 170 which drives the master piston 162 will be the pushtube associated with the fuel injector for Cylinder No. 1.

The intake valve rocker arm for Cylinder No. 1, shown at 172, is mounted for oscillation on the rocker arm shaft 174. When oscillated in a counterclockwise direction (as shown in FIG. 5) the rocker arm 172 acts against the top of a crosshead **28*a* mounted for reciprocating motion on a guide pin 30 which is fixed to the engine cylinder head 32. The crosshead 28*a* contacts the stems of the dual intake valves 180 which are normally biased to a closed position by valve springs 182. Positioned above the rocker arm 172 in the housing 100 are intake master bore 186 and intake slave bore 184. Slave piston 188 positioned in slave bore 184 is biased away from the rocker arm 172 by compression spring 192 while master piston 190 positioned in master bore 186 is biased toward rocker arm 172 by compression spring 193. The slave piston 188 and the master piston 190 are located on opposite sides of the rocker arm shaft 174 so that downward motion of slave piston 188 against the bias of spring 192 opens the intake valves 180. Upward motion of the intake pushtube 173 oscillates the intake rocker arm 172 in a counterclockwise direction and drives the master piston 190 upwardly against the bias of spring 193 thereby pumping oil 102 from the master bore 186**.

Intake slave bore 184 and master bore 186 are interconnected by a duct 194 which leads to the slave bore 132 and contains three valves. The first of these is a check valve 196 which permits flow of hydraulic fluid only toward the intake slave bore 184 and master bore 186 and then only when the slave piston 144 has moved to its extreme downward position. The second valve is a shuttle valve 198 located at the juncture of duct 194 and duct **142*a* which latter duct communicates with the master bore 140*a* associated with Cylinder No. 3. The shuttle valve 198 has an "hour glass" shape and is biased to a closed position by a compression spring 200. The third valve is a check valve 199 which permits flow through duct 194 only toward master bore 186**.

When shuttle valve 198 is in the closed or "rest" position, flow through the duct 194 between slave bore 184 and master bore 186 is prevented. Upon the application of hydraulic pressure to duct **142*a* caused by the movement of master piston 162*a* the shuttle valve 198 compresses the spring 200 and moves so that fluid passing through duct 194 can reach the master bore 186**.

A second duct 202 communicates directly from master bore 186 to slave bore 132 through a check valve 204 which allows fluid to flow into slave bore 132 when master piston 190 is driven upwardly by the intake rocker arm 172 and pushtube 173. When duct 202 is pressurized, the shuttle valve 138 also moves so as to block the flow of hydraulic fluid in duct 136.

A third duct 206 containing a check valve 208 communicates between slave bore 184 and a location in the master bore 186 opposite the upper region of the master piston 190 when that piston is in its rest position whereby the master piston 190 blocks flow through duct 206. The check valve 208 permits flow toward the master bore 186. A duct 210 communicates with the master bore 186 also opposite the upper region of the master piston 190, when that piston is in its rest position. Duct 210 returns to the sump 104. As shown in FIG. 5, master piston 190 is provided with a circumferential annulus 191 in its mid-region so that when the master piston 190 is in its "up" position, hydraulic fluid may flow from duct 206 through the check valve 208, around the master piston 190 and through the duct 210 to the sump 104. Master piston 190 has a second circumferential annulus 195 formed in its lower region. A duct 211 communicates between this annulus (when master piston 190 is in its "up" position) and the passageway 58 (FIG. 3) in the intake crosshead shank 54 thereby permitting oil to flow past the master piston 190 and through the duct 215 back to the sump 104.

A shut-off valve 217 is located in duct 211 between the master bore 186 and duct the 213. It is controlled so as to be open during the retarding mode of operation and closed during the positive power mode. Shut-off valve 217 may conveniently be a solenoid valve controlled by conduit 219 connected to the retarder control circuit as described below or a pressure actuated valve operated by the pressure in the duct 116 through duct 117. It will be understood that when the oil pressure within the intake crosshead is released, the crosshead will be deactivated. If, instead of using the intake crosshead shown in FIG. 3 it is desired to use the divided rocker arm of FIGS. 4A and 4B then the duct 212 will communicate with the passageway 94 in rocker arm 76.

Slave piston 188 has formed in its midregion a circumferential annulus 189. Duct 212 communicates between the slave bore 184 at a point opposite the annulus 189 of the slave piston 188 when that piston is in its "down" position and the passageway 58 of the crosshead shank 54 of the exhaust valve crosshead 28 (FIG. 3). If, instead of using the exhaust crosshead shown in FIG. 3 it is desired to use the divided rocker arm of FIGS. 4A, and 4B then the duct 212 will communicate with the passageway 94 in rocker arm section 76. Duct 214 communicates between the slave bore 184 at a point below the annulus 189 of the slave piston 188 when that piston is in its rest position and the sump 104.

The electrical control system for the engine retarder includes the vehicle battery 216 which is grounded at 218. The hot terminal of the battery 216 is connected, in series, to a fuse 220, a dash switch 222, a clutch switch 224, a fuel pump switch 226, the coil of the solenoid valve 112 and then to ground 218. Conduit 219 provides power to the shut-off valve 217 if a solenoid-type shut-off valve is employed. Preferably, a diode 228 is interposed between the solenoid of solenoid valve 112 and ground. The switches 222, 224, and 226 are provided to assure safe operation of the system. Switch 222 is a manual control accessible to the vehicle driver to deactivate the entire system. Switch 224 is an automatic switch connected to the vehicle clutch to deactivate the system whenever the clutch is disengaged so as to prevent engine stalling. Switch 226 is a second automatic switch connected to the fuel system to prevent or reduce engine fueling when the engine retarder is in operation.

Operation of the mechanism is as follows: When the solenoid valve 112 is actuated, oil or hydraulic fluid 102 flows through the solenoid valve 112 and into the control valve cylinder 114 raising the control valve 118 so that outlet passage 128 registers with the outlet duct 130. Hydraulic fluid then fills the slave bore 132 and the master piston bore 140 via duct 136 and shuttle valve 138 which is in its "rest" or "open" position. At about 50° before top dead center the injector pushtube 170 for Cylinder No. 1 moves upwardly (see FIG. 1, curve 10) and drives the master piston 162 upwardly (as viewed in FIG. 5). The pressure induced in the hydraulic fluid drives slave piston 144 downwardly and thereby opens the exhaust valves 158 to produce a compression release event at about the top dead center position of the piston of Cylinder No. 1 as shown by Curve 16 (see FIG. 2). When the slave piston 144 reaches the end of its travel, it uncovers the opening of duct 194 and the continued motion of master piston 162 causes hydraulic fluid to pass through the check valve 196 and into slave bore 184 forcing slave piston 188 to move downwardly (as viewed in FIG. 5). Slave piston 144 then begins to retract. Continued retraction of the slave piston 144 may be facilitated by various means. One such means is the provision of sufficient clearance between the slave piston 144 and the slave bore 132 so as to provide a controlled leakage. An alternative means is the provision of a small orifice in the head of the slave piston 144 to provide a controlled leakage. As a third alternative, an hydraulic reset mechanism as described in Cavanagh U.S. Pat. No. 4,399,787 may be employed. In this third alternative, the hydraulic reset mechanism replaces the adjusting screw 146. The downward motion of the intake slave piston 188 against the crosshead **28*a* forces the intake valves 180 open (see FIG. 2, curve 18). (Note that the bottom end of the intake slave piston 188 is slotted to clear rocker arm 172.) Simultaneously the annulus 189 of the slave piston 188 becomes aligned with ducts 212 and 214 so that the hydraulic pressure within the exhaust crosshead 28 (FIG. 3) is relieved. When this occurs, the piston 44 (FIG. 3) can reciprocate relative to the crosshead 28 without moving the crosshead thereby disabling, temporarily, the normal exhaust valve motion. (Note that Curve 12 of FIG. 1 which shows the normal motion of the exhaust valves does not appear on FIG. 2). Normal leakage causes the slave piston 188** to being to retract.

At about 190° of crank rotation, the fuel injector pushtube **170*a* for Cylinder No. 3 is actuated. Pushtube 170*a* moves the rocker arm 168*a* and its adjusting screw 166*a* so as to drive the master piston 162*a* upwardly within the master bore 140*a* and pressurize duct 142*a*. The pressure in duct 142*a* moves the shuttle valve 198 downwardly against its bias spring 200 so as to permit a flow of fluid from duct 194 into master bore 186 and duct 202 into bore 132. Relief flow past slave piston 144 as described above permits slave piston 188 to move upwardly and the intake valves to close at about 240° of crank rotation as shown in FIG. 2**.

In the event that earlier closing of the intake valves is desired, the duct **142*a*, instead of being directed to master bore 140*a*, may be directed to a master bore aligned with the exhaust pushtube for Cylinder No. 1 in the same manner as master bore 186 is aligned with the intake push tube 173 for Cylinder No. 1. This will provide a trigger impulse as shown by Curve 27 in FIG. 2 which is about 60 crank angle degrees in advance of Curve 24. Curve 27 reflects motion that would have resulted in Curve 12 of FIG. 1 except for the disabling of the exhaust valves 158. As the intake valves 180 close, duct 212 is also closed and the exhaust valve motion is restored to normal operation by oil supplied to the exhaust valve crosshead 28 through duct 213 from the low pressure oil pump 108. The normal motion of the intake pushtube 173 at about 340° of crank rotation oscillates the rocker arm 172 in a counterclockwise direction and drives master piston 190 upwardly (check valve 199 prevents flow back through passage 194) thereby returning hydraulic fluid through duct 202 and forcing the shuttle valve 138 upward so as to block the duct 136 and passing fluid through check valve 204 to the slave bore 132 and driving the slave piston 144 downwardly to again open the exhaust valves 158 (see FIG. 2, curve 22**).

Retraction of the master piston 162 as shown by Curve 10 in FIG. 1 allows the exhaust valves 158 to close after the second compression release event occurs. As intake master piston 190 moves upward, its lower annulus 195 aligns with duct 211 and dumps through duct 215 to sump 104 thus disabling the intake crosshead **28*a* and thereby deactivating the intake valves 180**.

When the slave piston 144 reaches the bottom of its travel, hydraulic fluid again flows through check valve 196 and duct 194 into the slave bore 184. At this time the slave piston 188 is in its uppermost position but the master piston 190 is still moving upwardly. Thus, the excess hydraulic fluid forces slave piston 188 downwardly to achieve a second "forced intake" as shown by Curve 21 of FIG. 2. Thereafter, when the master piston 190 reaches its uppermost position, duct 206 will be connected to duct 210 through annulus 191 so as to dump the hydraulic fluid to the sump 104. The release of the hydraulic fluid permits the slave piston 188 to retract and the intake valves to close at about 540 crank angle degrees.

It will be understood that the cycle of operation described above will be repeated when, just before 720° of crankshaft rotation, the fuel injector pushtube 170 for Cylinder No. 1 is again actuated. Ideally, the exhaust valve openings required for the compression release events should occur very rapidly and at the top dead center position of the engine piston. As soon as the gas pressure within the cylinder has been released, the exhaust valve should close. However, because a finite time is required to open or close the valves and to operate the hydraulic and mechanical portions of the apparatus, the opening of the exhaust valve typically begins in the vicinity of 40 crankangle degrees before the top dead center position while closing of the exhaust valve after the compression release event may begin in the vicinity of 20 crankangle degrees after top dead center. The optimum points for opening and closing of the exhaust and intake valves are also a function of the engine speed and the mechanical stiffness of the valve train components. It will be understood, therefore, that where valve actions herein are specified at particular crankangle positions the action may, in fact, occur at ±10° or more from the position specified. Further, while the compression release opening of the exhaust valve may extend over about 60° of crankshaft motion including the top dead center position of the engine piston involved, this action will be understood to have occurred substantially at the top dead center position of the piston. Similarly, where the intake valve is to be closed substantially at the bottom dead center position of the piston, it may entail valve motion occurring ±30 crankangle degress from the precise bottom dead center position of the piston. Finally, where it is required to open the intake valve substantially simultaneously with the closing of the exhaust valve it will be understood that the intake valve may begin to open about 60 crankangle degrees before the exhaust valve is fully closed.

As shown in FIG. 5, the retarding system for Cylinder No. 1 is interconnected with the systems for Cylinder Nos. 2 and 3 in that the injector motion for Cylinder No. 1 feeds Cylinder No. 2 (through duct 142) and is fed by Cylinder No. 3 (from duct 142*a*). The interrelationship of the retarding system for a six cylinder engine having the firing order 1, 5, 3, 6, 2, 4, 1 is shown in Table 1 below:

TABLE 1

| Injector Motion of Cyl. No. | Dumps forced intake of Cylinder No. |
|---|---|
| 3 | 1 |
| 1 | 2 |
| 2 | 3 |
| 5 | 4 |
| 6 | 5 |
| 4 | 6 |

From the above Table 1 it will be apparent that Cylinders Nos. 1, 2 and 3 are interconnected as are Cylinders Nos. 4, 5 and 6. In a six cylinder engine the cylinders are normally arranged in line although the cylinders may be grouped in separate housings containing 2 or 3 cylinders each. Where Cylinders 1, 2 and 3 are in one housing, it will be appreciated that the various interconnecting ducts shown in FIG. 5 may be incorporated into the housing 100. It will be understood that a separate solenoid valve 112 and control valve 118 may be employed for each engine cylinder as suggested by FIG. 5. However, if desired, one solenoid valve 112 and two control valves 118 may be used to operate the compression release system associated with two cylinders or one solenoid valve and three control valves may operate three cylinders in order to provide a more flexible retarding system.

While the description above has proceeded upon the basis of a six cylinder engine wherein the retarder hydraulic system is driven by the fuel injector pushtubes it will be appreciated that the invention disclosed is equally applicable to a system where the retarder is driven, for example, by the exhaust valve pushtubes. Similarly, the invention may be applied to engines having, for example, four or eight, or any other number, of cylinders, provided only that appropriate pushtubes or cams are selected to provide the hydraulic pulse at the proper time.

As shown by FIGS. 3–5 the apparatus of the present invention basically employs hydraulic and mechanical elements, with the exception of the solenoid valve 112. It will be appreciated that certain of the functions controlled by hydraulic or mechanical means may also be controlled by electrical or electronic means. Such a modification is shown in FIG. 7 where parts which are common to FIG. 7 and FIGS. 3 through 5 bear the same identification.

Figure 7:
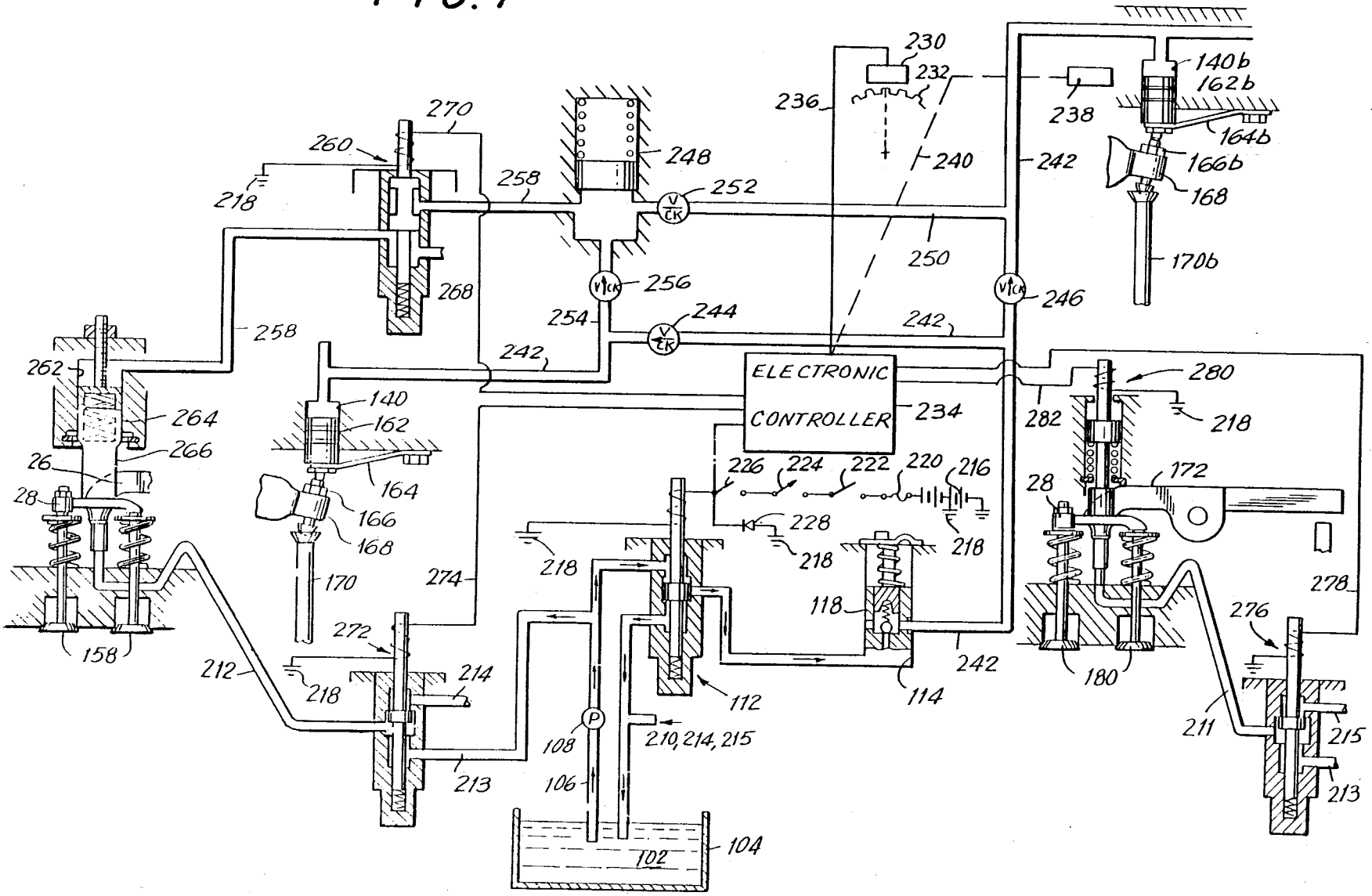
FIG. 7 is a diagrammatic view of an alternative mechanism which may be employed in accordance with the present invention.

Referring now to FIG. 7, it will be understood that the low pressure hydraulic system including the sump 104, the solenoid valve 112 and its controls 216 through 228, the control cylinder 114 and valve 118 are identical to the apparatus shown in FIG. 5. Similarly, each cylinder of the engine is provided with a master bore 140, 140*b*, a master piston 162, 162*b*, driven by the injector push tube 170, 170*b*, through the rocker arm 168, 168*b*, and adjusting screw mechanism 166, 166*b*. Finally, the exhaust valves 158 and the intake valves 180 may be actuated by a crosshead 28, 28*a* of the type shown in FIG. 3 or by a divided rocker arm of the type illustrated in FIGS. 4A and 4B.

In accordance with the alternative form of the invention, the slave pistons which operate the exhaust and intake valve crosshead are hydraulic or solenoid mechanisms which are actuated by an electrical signal from a timed controller as will be described in more detail below. As the exhaust and intake valves in this alternative arrangement are actuated by electrical signals, the timing and duration of which may be precisely set by an electronic controller, the mechanical components may be simplified and the retarding horsepower developed by the engine maximized.

Figure 6:
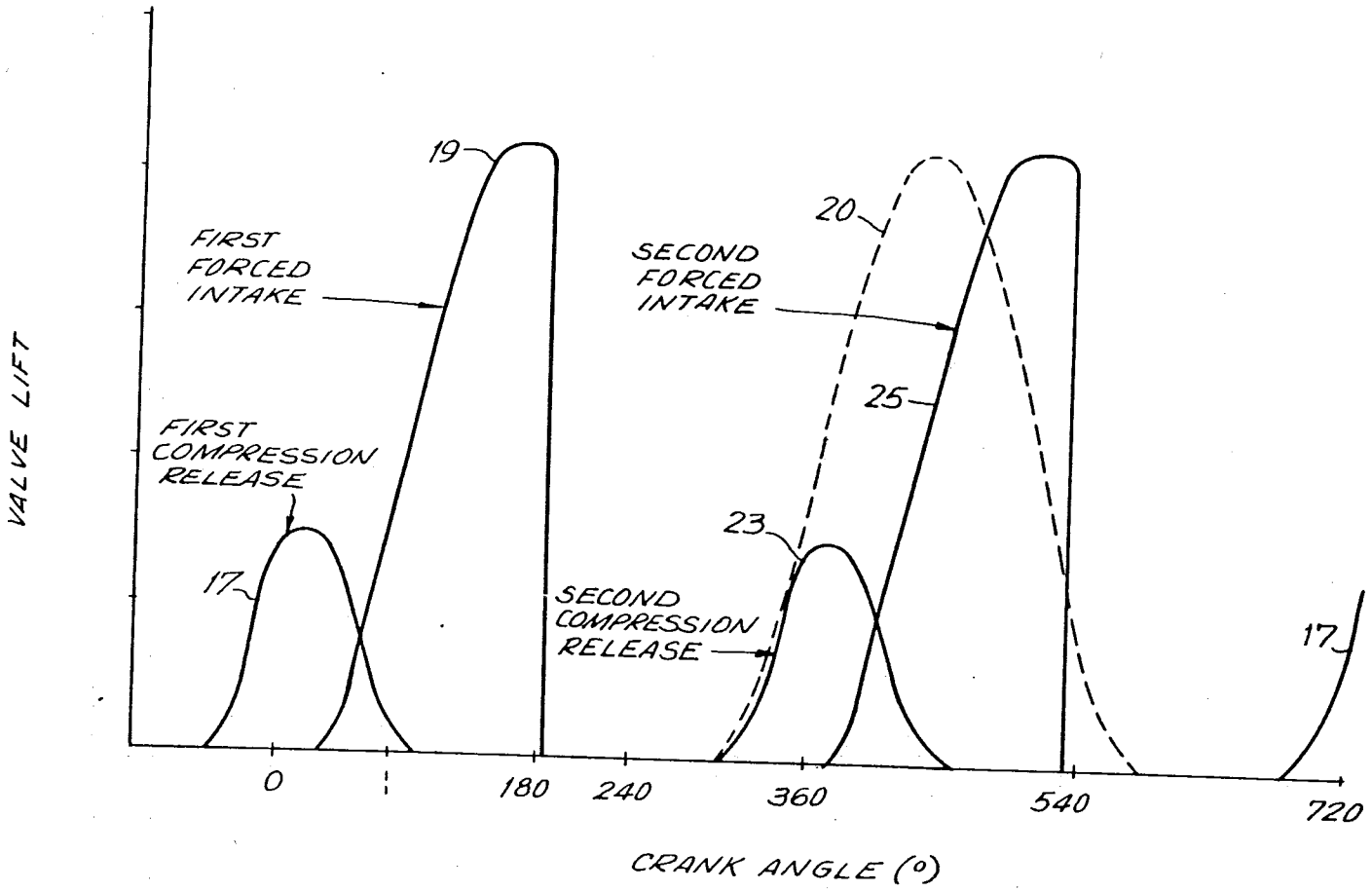
FIG. 6 is a graph similar to FIG. 2 showing a further modification of the valve action in accordance with the present invention whereby a compression release event occurs for each cylinder during each revolution of the engine crankshaft.

FIG. 6 is a graph somewhat similar to FIG. 2 but showing the motion of the exhaust and intake valves during two revolutions of the crankshaft during which time compression release events occur at about 0° and at about 360° of crankshaft rotation in accordance with the alternative form of the invention. Curve 17 represents the motion of the exhaust valve 158 which produces the first compression release event when the piston in Cylinder No. 1 is near the top dead center position following the normal compression stroke of the engine. Curve 17 is repeated near 720° of crankshaft rotation to indicate the beginning of a second cycle of operation of the mechanism. Curve 19 represents the first forced opening of the intake valves 180 which, similar to FIG. 2, occurs about 240° or more in advance of the normal opening of the intake valves. The normal opening of the intake valves, shown by the dotted curve 20 is inhibited by the present mechanism. Curve 23 represents the second forced opening of the exhaust valves 158 at about 360° of the crankshaft rotation while curve 25 represents the second forced opening of the intake valve 180 at about 380° of crankshaft rotation. It will be appreciated that the two forced intake events assure that a maximum charge of air is admitted to the cylinder during each crankshaft revolution so as to maximize the power dissipated during each compression release event. The additional means used to produce these results will now be described in conjunction with FIG. 7.

As shown in FIG. 7 a sensor 230 is directed, for example, toward the engine flywheel 232 so as to detect the timing mark associated, for example, with the top dead center (TDC) position of the piston in Cylinder No. 1. The sensor 230 may be of any of the known types of sensors which emit an electrical signal which may be fed into the electronic controller 234 through lead 236. Alternatively, a timing signal may be produced by a sensor 238 which senses the motion of one of the master pistons, for example, the master piston **162*b* driven by the pushtube 170*b* associated with the fuel injector for Cylinder No. 4. Pushtube 170*b* drives the rocker arm 168*b* and adjusting screw mechanism 166*b* and thence the master piston 162*b*. The signal from sensor 238 is directed to the controller 234 by the lead 240**.

Low pressure hydraulic fluid 102 from the solenoid valve 112 and control valve 118 is directed to master bores 140 and **140*b* by duct 242 through check valves 244, 246**.

Master bore **140*b* communicates with a high pressure accumulator 248 through ducts 242 and 250 and check valve 252 while master bore 140 communicates with the accumulator 248 through ducts 242 and 254 and check valve 256. It will be understood that whenever the solenoid valve 112 is opened, low pressure hydraulic fluid 102 will flow through duct 242 toward the check valves 244 and 246. Fluid at low pressure will flow through check valves 244, 246 and fill ducts 242, 250 and 254 and bores 140 and 140*b*. The motion of the injector pushtubes 170, 170*b* will pump hydraulic fluid 102 periodically from the master bores 140, 140*b* into the high pressure accumulator 248** thereby providing a reservoir of high pressure hydraulic fluid.

A duct 258 containing a three-way solenoid valve 260 communicates between the high pressure accumulator 248 and a slave bore 262 located above the exhaust valve crosshead 28. A slave piston 264 is mounted for reciprocating motion within the slave bore 262 and is provided with a slotted extension 266 adapted to engage the exhaust valve crosshead 28. A duct 268 returns to the sump 104 and interconnects with the duct 258 whenever the three-way solenoid valve 260 is deenergized. The solenoid valve 260 is actuated from the electronic controller 234 through lead 270. When the solenoid valve 260 is actuated, duct 258 permits the flow of high pressure hydraulic fluid from the accumulator 248 into the slave bore 262 so as to actuate the slave piston 264 and open the exhaust valves 158.

The exhaust valve crossheads 28 (see FIG. 3) is supplied with low pressure hydraulic fluid through ducts 213 and 212. As shown in FIG. 7, ducts 212 and 213 also communicate with a three-way solenoid valve 272 which is actuated by the controller 234 through lead 274. Duct 214 communicates between the solenoid valve 272 and the sump 104. Whenever the solenoid valve 272 is energized, the hydraulic pressure within the crosshead 28 will be released and the normal operation of the exhaust valves 158 by the rocker arm inhibited by the mechanism shown in FIG. 3. As noted above, the exhaust valves 158 alternatively may be inhibited or disabled by use of the divided rocker arm mechanism as shown in FIGS. 4A and 4B. It will be understood that the extension 266 of the slave piston 264 acts directly on the crosshead 28 to actuate the exhaust valve 158 even when the rocker arm 126 is inhibited from doing so.

Like the exhaust crosshead 28, the intake crosshead **28*a* may be supplied with low pressure hydraulic fluid through ducts 213 and 211. Ducts 211 and 213 also communicate with a three-way solenoid valve 276 which is actuated by the controller 234 through lead 278. Duct 215 communicates between the solenoid valve 276 and the sump 104. As with the solenoid valve 272 referred to above, the solenoid valve 276, when deactuated provides a supply of low pressure hydraulic fluid to the intake crosshead 28*a* as shown by FIG. 3 or the intake rocker arm 172 which may have the construction shown in FIGS. 4A and 4B. When the solenoid valve 276 is actuated, the hydraulic fluid in the crosshead or rocker arm is dumped through duct 215 to the sump 104** and the crosshead or rocker arm is disabled.

As shown in FIG. 7, a high force solenoid 280 is mounted above the intake crosshead **28*a* and adapted, when energized, to open the intake valves 180. The solenoid 280 is actuated by the controller 234 through lead 282. As the solenoid 280 acts directly on the body of the intake crosshead 28*a*, it is capable of opening the intake valves 180 even when the crosshead 28*a* has been disabled so that the rocker arm 172 will not actuate them. It will be understood that the hydraulic pulse mechanism illustrated in FIG. 7 with respect to the exhaust valves 158 may also be used to operate the intake valves 180** instead of the solenoid mechanism described above.

It will be appreciated that whenever the exhaust valves 158 are opened for a compression release event the force required to open the valves is the sum of the force required to compress the valve springs and the force required to overcome the pressure in the cylinder. The intake valves 180, however, are only opened when the cylinder pressure is low (i.e., approximately atmospheric) and therefore a relatively lower force is required. If it should be desired to use a solenoid device to open the exhaust valves 158, it may be necessary to employ a force multiplying device such as a pivoted lever to provide the required force.

The most common firing sequence for a six cylinder engine is 1, 5, 3, 6, 2, 4. This sequence may be converted to the corresponding crank angle position measured from top dead center as shown in Table 2, below:

TABLE 2

| Cylinder at TDC (Reference: Cyl. No. 1) | Crank Rotation /Degrees |
|---|---|
| 1 | 0°, 720° |
| 5 | 120° |
| 3 | 240° |
| 6 | 360° |
| 2 | 480° |
| 4 | 600° |

TABLE 2-continued

| Cylinder at TDC (Reference: Cyl. No. 1) | Crank Rotation /Degrees |
|---|---|
| 1 | 720° |

In order to provide two compression release events per cylinder for each two crankshaft revolutions as set forth in the chart of FIG. 6 the several solenoids may be operated in accordance with the schedule set forth in Table 3, below:

TABLE 3

| Crank Angle | Solenoid | On or Off | Action |
|---|---|---|---|
| 40° BTDC | 260 | On | Open Exhaust Valves |
| 20° ATDC | 260 | Off | Close Exhaust Valves |
| 30° ATDC | 280 | On | Open Intake Valves |
| 110° ATDC | 272 | On | Disable Exhaust Crosshead |
| 180° ATDC | 280 | Off | Close Intake Valves |
| 260° ATDC | 276 | On | Disable Intake Crosshead |
| 320° ATDC | 260 | On | Open Exhaust Valves |
| 380° ATDC | 260 | Off | Close Exhaust Valves |
| 380° ATDC | 280 | On | Open Intake Valves |
| 410° ATDC | 272 | Off | Enable Exhaust Crosshead |
| 480° ATDC | 276 | Off | Enable Intake Crosshead |
| 530° ATDC | 280 | Off | Close Intake Valves |

In FIG. 7, it was noted that the motions of the master pistons 162 and **162*b* for Cylinders Nos. 1 and 4 were interrelated since the injector pushtube 170*b* which drives the master piston 162*b* operates 120° in advance of the TDC position of Cylinder No. 1. Thus, the master piston 162*b* for Cylinder No. 4 can supply the high pressure hydraulic fluid required to perform the first compression release event for Cylinder No. 1. The normal motion of the exhaust pushrod for Cylinder No. 1 can charge the accumulator 248 for the second compression release event shown by curve 23 of FIG. 6**. The interrelationship of all of the cylinders of a six-cylinder engine having the firing order 1, 5, 3, 6, 2, 4, 1 is shown in Table 4 below:

TABLE 4

| First Compression Release Cylinder No. | Injector Feeding Accumulator Cylinder No. |
|---|---|
| 1 | 4 |
| 5 | 1 |
| 3 | 5 |
| 6 | 3 |
| 2 | 6 |
| 4 | 2 |

The operation of the mechanism shown in FIG. 7 is evident from Table 3 and FIG. 6. At about 40° BTDC, the controller 234 triggers solenoid 260 so that an hydraulic pulse from the accumulator 248 actuates the slave piston 264 so as to open the exhaust valves 158 and produce the first compression release event (FIG. 6, Curve 17). The solenoid 260 is shut off at about 20° ATDC so as to permit the exhaust valves to close as shown by FIG. 6, Curve 17. The normal motion of the exhaust valves 158 is disabled at least during the period 110° ATDC-410° ATDC by actuating the solenoid valve 272 so as to depressurize the exhaust crosshead or rocker arm. If desired, the exhaust crosshead may be disabled during the whole period of operation of the compression release retarder.

The first forced intake motion, as shown by curve 19 of FIG. 6 is accomplished by energizing the solenoid 280 at about 30° ATDC and de-energizing solenoid 280 at about 180° ATDC thereby opening and closing, respectively, the intake valves 180. The normal motion of the intake valves 180 is inhibited at least during the period 260° ATDC-580° ATDC by energizing the solenoid valve 276 so as to depressurize the intake crosshead or rocker arm. If desired, the intake crosshead may be disabled during the whole period of operation of the compression release retarder.

The second compression release event occurs at about 360° ATDC from energizing the solenoid valve 260 during the period 320° ATDC-380° ATDC so as to open and close the exhaust valves 158 as shown by Curve 23 of FIG. 6.

The second force intake motion, as shown by Curve 25 of FIG. 6 is accomplished by energizing the solenoid 280 during the period 380° ATDC-530° ATDC thereby respectively opening and closing the intake valves 180. The second forced intake action is designed to assure that sufficient air is ingested so as to maximize the ensuing compression release event.

It will be appreciated that since the mechanism of FIG. 7 is under the influence of the electronic controller 234, the electrical control pulses can be varied as may be desired to maximize the performance of the system independent of restraints resulting from mechanical limitations. In particular, the valve timing may be varied as a funtion of engine speed to optimize the retarding horsepower developed by the engine.

Table 4 illustrates the interrelationship of the cylinders for a six cylinder engine having the firing order 1, 5, 3, 6, 2, 4, 1 where a separate accumulator 248 is provided for each cylinder. It is within the scope of the invention to utilize only one or two accumulators for a six cylinder engine thereby minimizing the number of required parts. In addition the compression releases on some cylinders may be deactivated to achieve progressive levels of retarding horsepower.

Although the invention as depicted in FIG. 7 has been described in connection with a six-cylinder engine having a particular firing order, it will be understood that it is equally applicable to engines having four, eight or other numbers of cylinders. Similarly while a compression release retarder driven by the injector pushtube has been described, the invention is also applicable to retarders driven by other appropriate pushtubes.

The terms and expressions which have been employed are used as terms of description and not of limitation and there is no intention in the use of such terms and expressions of excluding any equivalent of the features shown and described or portions thereof, but it is recognized that various modifications are possible within the scope of the invention claimed.

What is claimed is:

1. A process for compression release retarding of a cycling multi-cylinder four cycle internal combustion engine having a crankshaft and an engine piston operatively connected to said crankshaft for each cylinder thereof and having intake and exhaust valves for each cylinder thereof, comprising, for at least one cylinder thereof, the steps of reducing the flow of fuel to said cylinder, commencing opening the exhaust valve for said cylinder prior to the top dead center position of the said engine piston during an upstroke of the piston corresponding to its compression stroke during normal operation of the engine to produce a first compression release retarding event, closing said exhaust valve after the top dead center position of said engine piston, opening said intake valve during the ensuing downstroke of the piston to produce a first forced intake, closing said intake valve at substantially the ensuing bottom dead center position of said engine piston, disabling said exhaust valve from moving at the point it would move in the cycle during normal operation of the engine, disabling said intake valve from moving at the point it would move in the cycle during normal operation of the engine, commencing reopening said exhaust valve substantially at the ensuing top dead center position of the engine position to produce a second compression release retarding event, reopening said intake valve during the next downstroke of the piston to produce a second forced intake, reclosing said exhaust valve after the top dead center position of said engine piston, and reclosing said intake valve at substantially the ensuing bottom dead center position of said engine piston whereby one compression release event is produced in said one cylinder during each revolution of said crankshaft.

2. A process as described in claim 1 wherein the first opening motion of the exhaust valve is at about 40° BTDC and the first closing event of the exhaust valve is completed at about 180° ATDC, the first opening motion of the intake valve is at about 10° BTDC and the first closing event of the intake valve is completed at about 210° ATDC, the second opening motion of the exhaust valve is at about 350° ATDC, the second closing event of the exhaust valve is completed at about 450° ATDC, the second opening motion of the intake valve is at about 370° ATDC and the second closing event of the intake valve is complete at about 540° ATDC.

3. A process as described in claim 2 wherein the exhaust valve is disabled from moving at the point it would move in the cycle during normal operation of the engine at least during the period from about 130° ATDC to about 370° ATDC and the intake valve is disabled from moving at the point it would move in the cycle during normal operation of the engine at least during the period from about 340° ATDC to about 580° ATDC.

4. A process as described in claim 1 wherein the first opening motion of the exhaust valve is at about 40° BTDC and the first closing event of the exhaust valve is completed at about 90° ATDC, the first opening motion of the intake valve is at about 30° ATDC and the first closing event of the intake valve is completed at about 180° ATDC, the second opening motion of the exhaust valve is at about 300° ATDC, the second closing event of the exhaust valve is completed at about 450° ATDC, the second opening motion of the intake valve is at about 380° ATDC and the second closing event of the intake valve is completed at about 540° ATDC.

5. A process as described in claim 4 wherein the exhaust valve is disabled from moving at the point it would move in the cycle during normal operation of the engine at least during the period from about 130° ATDC to about 370° ATDC and the intake valve is disabled from moving at the point it would move in the cycle during normal operation of the engine at least during the period from about 340° ATDC to about 580° ATDC.

6. An engine retarding system of a gas compression release type comprising a multi-cylinder four cycle internal combustion engine having a crankshaft and a camshaft driven in synchronism with said crankshaft, engine piston means associated with said crankshaft, exhaust valve means and intake valve means associated with each cylinder of said engine, first and second pushtube means driven from said camshaft, hydraulic fluid supply means, hydraulically actuated first piston means associated with said exhaust valve means to open said exhaust valve means, second piston means actuated by said first pushtube means and hydraulically interconnected with said first piston means and said hydraulic fluid supply means to open said exhaust valve means during an upstroke of the engine piston associated with said exhaust valve means corresponding to its compression stroke during normal operation of the engine to produce a first compression release event, first means responsive to hydraulic pressure supplied by said hydraulic fluid supply means adapted to disable the normal operation of said exhaust valve means, second means responsive to hydraulic pressure supplied by said hydraulic fluid supply means adapted to disable the normal operation of said intake valve means, third piston means associated with said intake valve means and hydraulically interconnected with said first and second piston means to open said intake valve means at a predetermined time, fourth piston means actuated by said second pushtube means and hydraulically interconnected with said first, second and third piston means to actuate said first piston means to open said exhaust valve means during an upstroke of the engine piston associated with said exhaust valve means corresponding to its exhaust stroke during normal operation of the engine to produce a second compression release event and thereafter to actuate said third piston means to open said intake valve means whereby one compression release event is produced in each cylinder during each revolution of said crankshaft.

7. An engine retarding system of a gas compression release type comprising a multi-cylinder four cycle internal combustion engine having a crankshaft and a camshaft driven in synchronism with said crankshaft, engine piston means associated with said crankshaft, exhaust valve means and intake valve means associated with each cylinder of said engine, pushtube means driven from said camshaft and associated with each of said exhaust valve means, hydraulic fluid supply means, first piston means associated with said exhaust valve means to open and close said exhaust valve means once during each revolution of said crankshaft, second piston means actuated by said pushtube means and hydraulically interconnected with said first piston means and said hydraulic fluid supply means, fluid pressure accumulator means interposed between said first piston means and said second piston means, said accumulator adapted to receive hydraulic fluid pressurized by said second piston means, first solenoid valve means interposed between said accumulator means and said first piston means, hydraulically actuated exhaust valve disabling means supplied by said hydraulic fluid supply means, second solenoid valve means communicating between said hydraulic fluid supply means and said exhaust valve disabling means, third piston means associated with said intake valve means to open and close said intake valve means, solenoid means interconnected with said third piston means, hydraulically actuated intake valve disabling means supplied by said hydraulic fluid supply means, third solenoid valve means communicating between said hydraulic fluid supply means and said intake disabling means, first check valve means interposed between said accumulator and said second piston means, second check valve interposed between said hydraulic fluid supply means and said second piston means, sensing means responsive to the position of said crankshaft and electronically controlled means communicating electrically with said sensor means, said first, second and third solenoid valve means and said solenoid means.

8. An engine retarding system of a gas compression release type comprising a multi-cylinder four cycle internal combustion engine having a crankshaft and a camshaft driven in synchronism with said crankshaft, engine piston means associated with said crankshaft, exhaust valve means and intake valve means associated with each cylinder of said engine, pushtube means driven from said camshaft and associated with said exhaust valve means, hydraulic fluid supply means, first piston means associated with said exhaust valve means to open said exhaust valve means during each revolution of said crankshaft, second piston means actuated by said pushtube means and hydraulically interconnected with said first piston means and said hydraulic fluid supply means, fluid pressure accumulator means interposed between said second piston means and said first piston means and adapted to receive pressurized hydraulic fluid from said second piston means, first solenoid valve means interposed between said accumulator means and said first piston means, hydraulically actuated exhaust valve disabling means supplied by said hydraulic fluid supply means, second solenoid valve means communicating between said hydraulic fluid supply means and said exhaust valve disabling means, third piston means associated with said intake valve means to open said intake valves during each revolution of said crankshaft and hydraulically interconnected with said first piston means and said hydraulic fluid supply means, hydraulically actuated intake valve disabling means associated with said intake valve means and supplied by said hydraulic fluid supply means, third solenoid valve means communicating between said hydraulic fluid supply means and said intake valve disabling means, fourth solenoid valve means interposed between said accumulator means and said third piston means, first check valve means interposed between said accumulator means and said second piston means, second check valve means interposed between said hydraulic fluid supply means and said second piston means, sensing means responsive to the position of said crankshaft and electronic controller means communicating electronically with said sensor means and said first, second, third and fourth solenoid valve means, whereby said exhaust valve means and said intake valve means are opened during each revolution of said crankshaft.

9. An engine retarding system of a gas compression release type adapted to perform the process described in claim 1, said system comprising a cycling multi-cylinder four cycle internal combustion engine having a crankshaft and an engine piston operatively connected to said crankshaft for each cylinder thereof and having intake and exhaust valves for each cylinder thereof and further comprising for at least one cylinder thereof means for reducing the flow of fuel to said cylinder, means to commence opening the exhaust valve for said cylinder prior to the top dead center position of the said engine piston during an upstroke of the piston corresponding to its compression stroke during normal operation of the engine to produce a first compression release retarding event, means for closing said exhaust valve after the top dead center position of said engine piston, means for opening said intake valve during the ensuing downstroke of the piston to produce a first forced intake, means for closing said intake valve at substantially the ensuing bottom dead center position of said engine piston, means for disabling said exhaust valve from moving at the point it would move in the cycle during normal operation of the engine, means for disabling said intake valve from moving at the point it would move in the cycle during normal operation of the engine, means for commencing reopening said exhaust valve substantially at the ensuing top dead center position of the engine piston to produce a second compression release retarding event, means for reopening said intake valve during the next downstroke of the piston to produce a second forced intake, means for reclosing said exhaust valve after the top dead center position of said engine piston, and means for reclosing said intake valve at substantially the ensuing bottom dead center position of said engine piston whereby one compression release event is produced in said cylinder during each revolution of said crankshaft.

* * * * *